US010151146B2

(12) United States Patent
Lehr et al.

(10) Patent No.: US 10,151,146 B2
(45) Date of Patent: Dec. 11, 2018

(54) DRILLING SYSTEM WITH ADAPTIVE STEERING PAD ACTUATION

(71) Applicant: Baker Hughes Incorporated, Houston, TX (US)

(72) Inventors: Joerg Lehr, Celle (DE); Arne Deiters, Hannover (DE); Sebastian Freier, Hannover (DE); Maximilian Schlegel, Hannover (DE); Bastian Sauthoff, Hannover (DE)

(73) Assignee: Baker Hughes, a GE company, LLC, Houston, TX (US)

( * ) Notice: Subject to any disclaimer, the term of this patent is extended or adjusted under 35 U.S.C. 154(b) by 943 days.

(21) Appl. No.: 14/475,277

(22) Filed: Sep. 2, 2014

(65) Prior Publication Data

US 2016/0060959 A1 Mar. 3, 2016

(51) Int. Cl.
*E21B 7/06* (2006.01)

(52) U.S. Cl.
CPC ..... *E21B 7/062* (2013.01)

(58) Field of Classification Search
CPC . E21B 7/062; E21B 7/04; E21B 7/046; E21B 7/06; E21B 7/068; E21B 7/067; E21B 7/00; E21B 17/1014; E21B 17/10; E21B 17/05; E21B 41/0035
See application file for complete search history.

(56) References Cited

U.S. PATENT DOCUMENTS

| | | | |
|---|---|---|---|
| 2005/0056463 | A1 | 3/2005 | Aronstam et al. |
| 2005/0150692 | A1 | 7/2005 | Ballantyne et al. |
| 2009/0044979 | A1 | 2/2009 | Johnson et al. |
| 2014/0209389 | A1 | 7/2014 | Sugiura et al. |

FOREIGN PATENT DOCUMENTS

WO 2009129386 A2 10/2009

*Primary Examiner* — Wei Wang
(74) *Attorney, Agent, or Firm* — Mossman, Kumar & Tyler, PC

(57) ABSTRACT

A bottomhole assembly (BHA) has a first section, a second section, and a drilling motor disposed along the second BHA section. The first BHA section is connected to the second BHA section with a flex sub. A steering assembly positioned along the BHA includes a first steering unit and an axially spaced apart second unit. Each steering unit has at least one pad. During operation, the first steering unit generates a force in a first direction and the second steering unit generates a force in a second direction different from the first direction. The first and the second steering units thereby cooperate to axially misalign the first BHA section and the second BHA section at the flex sub.

18 Claims, 5 Drawing Sheets

DRILLING SYSTEM WITH ADAPTIVE STEERING PAD ACTUATION

CROSS-REFERENCE TO RELATED APPLICATIONS

None.

BACKGROUND OF THE DISCLOSURE

1. Field of the Disclosure

This disclosure relates generally to oilfield downhole tools and more particularly to drilling assemblies utilized for drilling deviated boreholes.

2. Background of the Art

To obtain hydrocarbons such as oil and gas, boreholes or wellbores are drilled by rotating a drill bit attached to the bottom of a drilling assembly (also referred to herein as a "Bottom Hole Assembly" or ("BHA"). The drilling assembly is attached to the bottom of a tubing, which is usually either a jointed rigid pipe or a relatively flexible spoolable tubing commonly referred to in the art as "coiled tubing." The string comprising the tubing and the drilling assembly is usually referred to as the "drill string." When jointed pipe is utilized as the tubing, the drill bit is rotated by rotating the jointed pipe from the surface and/or by a mud motor contained in the drilling assembly. In the case of a coiled tubing, the drill bit is rotated by the mud motor. During drilling, a drilling fluid (also referred to as the "mud") is supplied under pressure into the tubing. The drilling fluid passes through the drilling assembly and then discharges at the drill bit bottom. The drilling fluid provides lubrication to the drill bit and carries to the surface rock pieces disintegrated by the drill bit in drilling the wellbore. The mud motor is rotated by the drilling fluid passing through the drilling assembly. A drive shaft connected to the motor and the drill bit rotates the drill bit.

A substantial proportion of current drilling activity involves drilling deviated wellbores to more fully exploit hydrocarbon reservoirs. A deviated wellbore is a wellbore that is not vertical (e.g., a horizontal borehole). In many cases, a vertical well is drilled and then a deviated branch bore is "kicked off" the vertical well. The sharper the "build radius" at the kick off point, the faster the branch bore can reach a horizontal orientation. The present disclosure provides devices, systems, and methods for achieving a high "build rate" delivering a "small build radius" as well as meeting other needs of the prior art.

SUMMARY OF THE DISCLOSURE

In aspects, the present disclosure provides an apparatus for forming a wellbore in a subterranean formation. The apparatus may include a bottomhole assembly having a first section and a second section; a flex sub allowing axial misalignment between the first BHA section and the second BHA section; a drilling motor disposed along the second BHA section; and a steering assembly positioned along the bottomhole assembly. The steering assembly may include a first steering unit and an axially spaced apart second steering unit. Each unit has at least one pad generating a force. The first steering unit generates a force in a first direction and the second steering unit generates a force in a second direction different from the first direction. The first and the second steering units cooperate to axially misalign the first BHA section and the second BHA section at the flex sub.

In aspects, the present disclosure provides a method for forming a wellbore in a subterranean formation. The method may use a bottomhole assembly (BHA) having a first section, a second section, and a drilling motor disposed along the second BHA section. The method may include the steps of connecting the first BHA section to the second BHA section with a flex sub; positioning a steering assembly along the BHA, the steering assembly including a first steering unit having at least one pad and a second steering unit having at least one pad and axially spaced apart from the first steering unit; generating a force in a first direction using the first steering unit; and generating a force in a second direction using the second steering unit, the second direction being different from the first direction, the first and the second steering units thereby cooperating to axially misalign the first BHA section and the second BHA section at the flex sub.

Examples of certain features of the disclosure have been summarized rather broadly in order that the detailed description thereof that follows may be better understood and in order that the contributions they represent to the art may be appreciated. There are, of course, additional features of the disclosure that will be described hereinafter and which will form the subject of the claims appended hereto.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein.

DETAILED DESCRIPTION OF THE DISCLOSURE

As will be appreciated from the discussion below, aspects of the present disclosure provide a drilling assembly that can generate a high build rate while drilling a deviated branch from a main vertical bore. The high build rate, e.g., 25 degrees or greater per one hundred feet, can form bores that have more length in a pay zone, which then exposes more of a hydrocarbon reservoir to a production bore. Generally speaking, arrangements of the present disclosure use two or more steering units to steer a bottomhole assembly (BHA). The steering units each have one or more steering pads. The steering pad(s) of one steering unit are angularly offset from the steering pad(s) of the other steering unit. Thus, the steering units can generate opposing steering forces. Because the steering forces are axially offset, a leveraging action enhances the steering force at a drill bit. A flexible section may be used to allow the bottom hole assembly to accommodate this leveraging action. Illustrative non-limiting embodiments are described in greater detail below.

Figure 1:
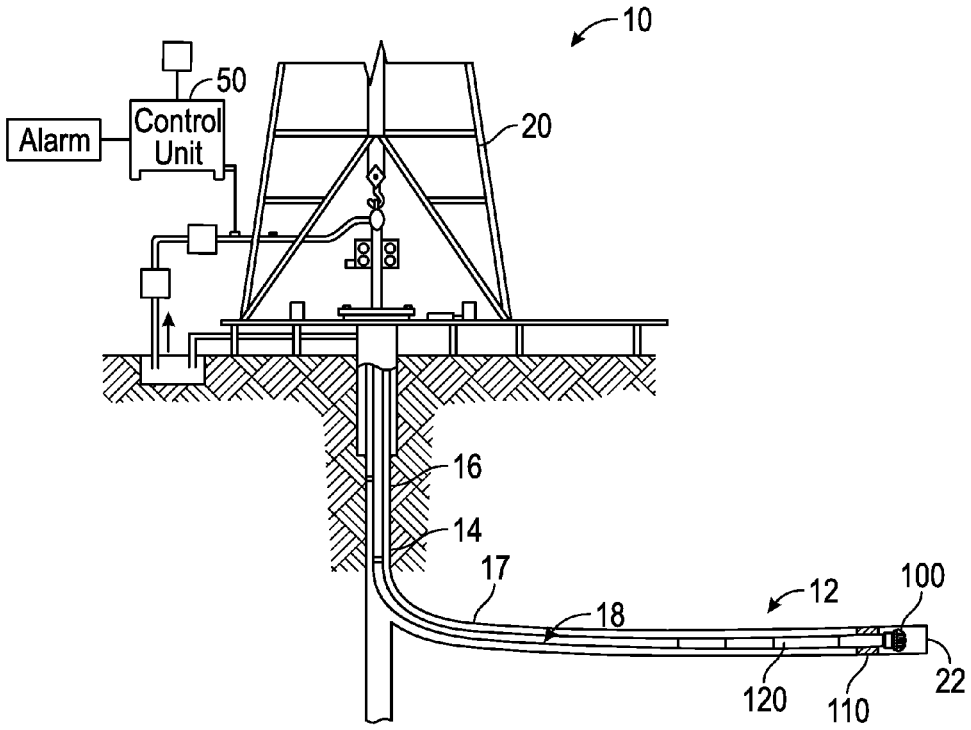
FIG. 1 illustrates a drilling system made in accordance with one embodiment of the present disclosure.

Referring now to FIG. 1, there is shown one illustrative embodiment drilling system 10 that uses a steerable drilling assembly for steering a bottomhole assembly (BHA) 12 to directionally drilling a wellbore 14. The wellbore 14 has a vertical section 16 and a deviated section 17. While shown as horizontal, the deviated section 17 may have any inclination or inclinations relative to vertical. Also, while a land-based rig is shown, these concepts and the methods are equally applicable to offshore drilling systems. The system 10 may include a drill string 18 suspended from a rig 20. The drill string 18, which may be jointed tubulars or coiled tubing, may include power and/or data conductors such as wires for providing bidirectional communication and power transmission. In one configuration, the BHA 12 includes a drill bit 100, a steering assembly 110 that steers the drill bit 100, and a drilling motor 120 for rotating the drill bit 100. The drill bit 100 may be rotated by using the drilling motor 120 and/or by rotating the drill string 18.

Figure 2:
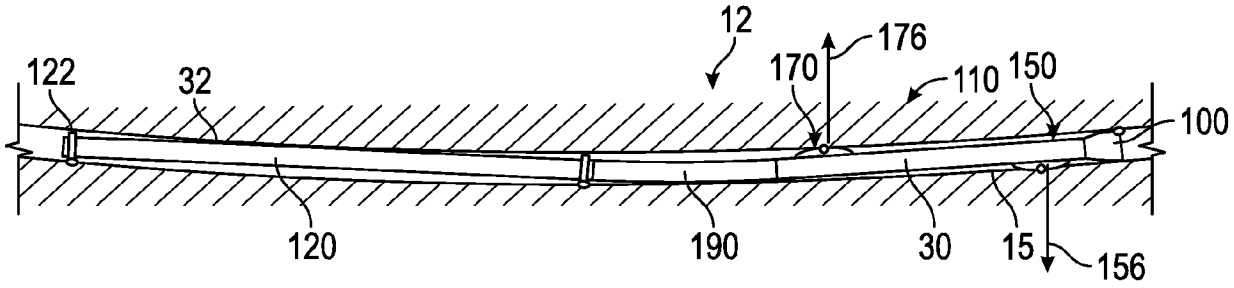
FIG. 2 schematically illustrates a bottomhole assembly (BHA) having a steering assembly made in accordance with one embodiment of the present disclosure.

Referring now to FIG. 2, there is shown a BHA 12 that includes one embodiment of a steering assembly 110 for steering the drill bit 100. The BHA 12 has a lower section 30 and an upper section 32 The drill bit is connected to a downhole end of the lower section 30 and a drilling motor is connected to an uphole end of the lower section 30. In one embodiment, the steering assembly 110 includes a first steering unit 150, a second steering unit 170, and a flex sub 190. The steering assembly 100 generates a high build rate by using the first and the second steering forces 150, 170 to apply opposing and axially spaced apart forces to a borehole wall 15. These opposing forces cooperate to point the drill bit 100 in a desired drilling direction. T Referring to FIG. 3, there is sectionally shown the first steering unit 150 that includes three force application pads 152. Because the pads 152, one or more at 150 or 170, are distributed on an outer circumferential surface 154, equally, e.g., at one-hundred twenty degree intervals or not equally, only one of the pads 152 are visible. The pads 152 may be identical within each steering unit 150, 170. Alternatively, either or both steering units 150, 150 may have pads of different shapes. The pads 152 can move radially outward and inward. A hydraulically-operated piston assembly (not shown) may be used to displace the pad 152 outward into engagement with the borehole wall 15, which creates the steering force. Each pad 152 may be independently operated to control the amount of the force exerted to an adjacent borehole wall or operated to adjust an defined pad extension distance with to goal to adjust a desired build rate angle The second steering unit 170 is structurally similar to the first steering unit 150 and also includes three pads 172 that are distributed on an outer circumferential surface 174 at one-hundred twenty degree intervals. However, the angular location of the pads 152 is offset relative to the angular location of the pads 172. The angular offset is selected to allow the pads 152 of the first steering unit 150 to have a force vector that is directionally differently from the force vector generated by the pads 172 of the second steering unit 170. In one non-limiting embodiment, the angular offset is selected to cause the steering forces generated by the steering units 150, 170 to be in opposite directions.

The flex sub 190 flexibly connects a lower section 30 of the BHA 12 having the steering units 150, 170 to an upper section 32 of the BHA 12, which has the drilling motor 120 (FIG. 2). The flex sub 190 allows a long axis 34 of the lower section 30 to be misaligned with a long axis 36 of the upper section 32. Thus, the misalignment occurs at the flex sub 190. In one arrangement, the flex sub 190 may be a flexible joint (e.g., a tubular) that is configured to be less rigid than the lower and upper sections 30, 32. For example, the flex sub 190 may be formed of a material that is less rigid than a material making up the lower and upper sections 30, 32. For instance, the flex sub 190 may be formed of titanium and the lower and upper sections 30, 32 may be formed of steel. Alternatively or additionally, the flex sub 190 may be constructed to be more flexible than the lower and upper sections 30, 32. For instance, the flex sub 190 may be formed of materials similar to that used for the lower and upper sections 30, 32. However, the flex sub 190 may include a tubular or other structure having a diameter, wall thicknesses, or other structural dimension that allow the flex sub 190 to be more flexible or elastic than the lower and upper sections 30, 32. By elastically deforming, the flex 190 allows the steering units 150, 170 to bend the BHA 12 with reduced resistance and less risk of damage.

Figure 3:
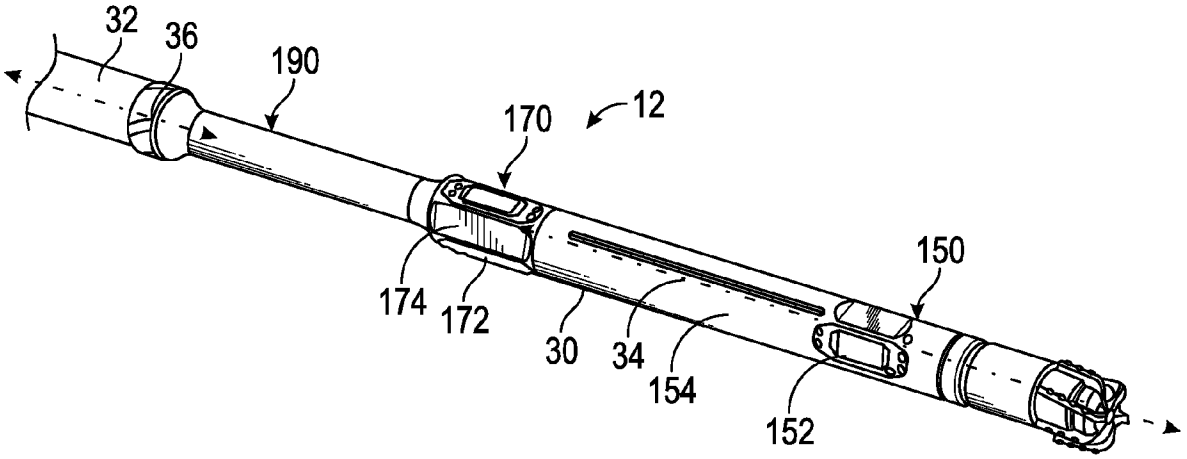
FIG. 3 isometrically illustrates steering units for the FIG. 2 embodiment made in accordance with one embodiment of the present disclosure.
Figure 4:
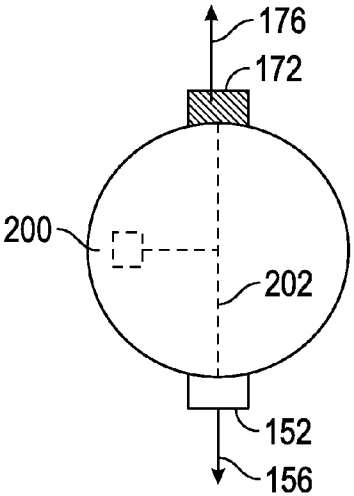
FIG. 4 illustrates steering forces generated by steering units made in accordance with one embodiment of the present disclosure.

While FIG. 3 shows the steering units 150, 170 having three pads, greater or fewer pads may be used. Indeed, the opposing forces generated by the steering units 150, 170 may be generated by using only one pad on each steering unit. For example, FIG. 4 schematically illustrates steering units 150, 170 (FIG. 3) that have one pad 152, 172 each, respectively. The pads 152, 172 are offset by 180 degrees.

When pressed against the borehole wall 15, the pads 152, 172 generate force vectors 156, 176 in opposite directions. Referring to FIG. 2, because the force vectors 156, 176 are applied at axially spaced apart locations, a turning force is applied to the BHA lower section 30, which points the drill bit 100 to a desired direction.

Referring to FIG. 3, in some embodiments, the steering units 150, 170 may be energized by pressurized hydraulic fluid from a suitable hydraulic source 200. In one arrangement, a single hydraulic line 202 supplies hydraulic fluid to the offset pads 152, 172. If two pads or more were used for each steering unit, then a separate hydraulic line may be used to supply hydraulic fluid to each set of angularly offset pads. In all cases, supplying pressurized fluid in one hydraulic line causes two axially spaced apart pads to extend in opposite directions.

It should be understood that other embodiments may use separate hydraulic lines for some or all of the pads 152, 172. In such embodiments, the pads 152 of the first steering unit 150 may be operated independently of the pads 172 of the second steering unit 170.

Figure 5:
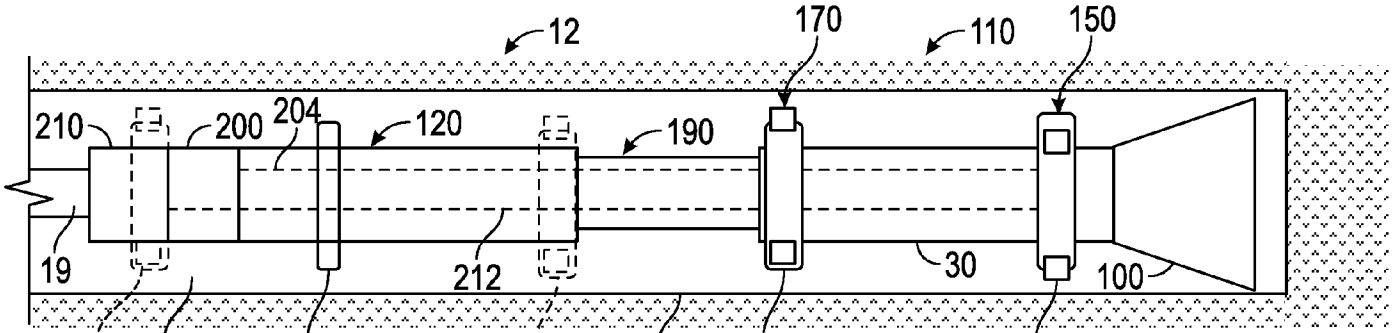
FIG. 5 schematically illustrates a BHA having a steering assembly made in accordance with one embodiment of the present disclosure.

Referring to FIG. 5, there are shown further details of the BHA 12. As discussed previously, the BHA includes the drill bit 100, steering assembly 110, the flex sub 190, and the drilling motor 120. A coiled tubing string 19 may be used to convey the BHA 12 into the borehole 14. Also, one or more stabilizers 122 may be used to support the BHA 12 and coiled tubing string 19. For example, the stabilizers 122 may be fixed blade structures that can maintain a space or gap between the BHA 12 and the borehole wall 15.

The hydraulic source 200 discussed previously may be positioned anywhere along the BHA 12. For instance, the hydraulic source 200 may be positioned uphole of the drilling motor 120. In such an embodiment, one or more hydraulic lines 204 may be used to convey pressurized hydraulic fluid to steering units 150, 170. The hydraulic lines 204 may be routed through the drilling motor 120 and also through the flex sub 190. In other embodiments, the hydraulic source 200 may be positioned in the lower BHA section 30.

The BHA 12 may also include a bidirectional communication and power module (BCPM) 210 and an associated power and/or data transmission line 212. Like the hydraulic line 204, the power and/or data transmission line 212 can extend along the entire length of the BHA 12. Thus, for example, the line 212 can transfer electrical power from the BCPM 210 to the steering unit 110 and provide two-way data communication between the surface or BCPM 210 and sensors (not shown) at the steering unit 110. In some embodiments, the steering units 150, 170 may be energized using electrical power. For example, electric motors (not shown) may be used in lieu of hydraulic fluid to displace the pads 152, 172. In such configurations, the BCPM may provide electrical power and to the electrically actuated steering units 150, 170.

It should be understood that the steering assembly 110 can be employed in numerous variants that each will provide enhanced build rates. Illustrative non-limiting embodiments are described below.

Figure 6:
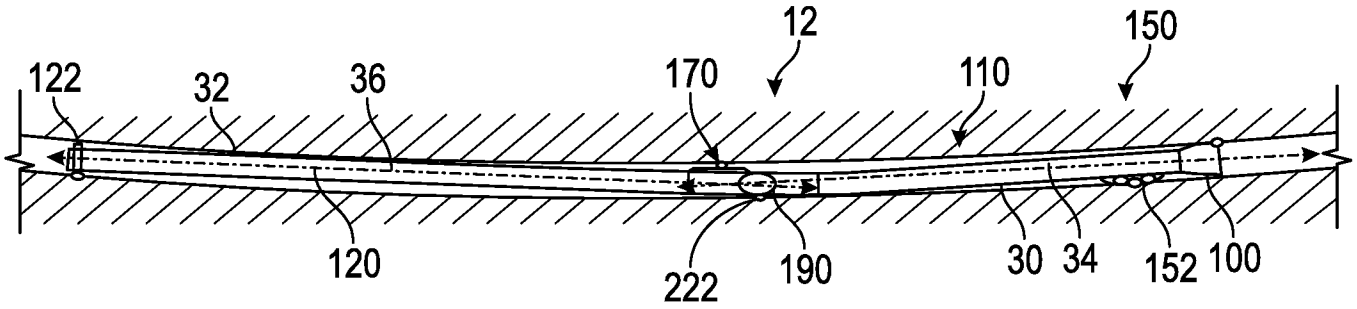
FIG. 6 schematically illustrates a BHA having a another steering assembly made in accordance with one embodiment of the present disclosure.

Referring now to FIG. 6, there is shown the BHA 12 that includes another embodiment of a steering assembly 110 for steering a drill bit 100. The BHA 12 may include a drilling motor 120 and one or more centralizers 122. The steering assembly 110 includes a first steering unit 150 and a second steering unit 170 that are on opposing ends of a flex sub 190. In this embodiment, the first steering unit 150 is positioned close to the drill bit 100 and the second steering unit 170 is positioned at or near the connection between the flex sub 190 and the upper BHA section 32. A centralizer 122 may be positioned at or near the opposite end of the upper BHA section 32.

In this embodiment, the first steering unit 150 alters the position of the long axis 34 of the lower section 30 and the second steering unit 170 alters the position of the long axis 36 of the upper section 32. These positions are altered in opposing directions. In a manner previously described, the misalignment of the long axes 34, 36 occurs at the flex sub 190.

Further, in this embodiment, the flex sub 190 uses an articulated mechanical connector 222 to flexibly connect the lower BHA section 30 to the upper BHA section 32. For example, the mechanical connector 222 may be a ball and seat joint, knuckle joint, universal joint, or any other joint that allows the long axis 34 of the lower section 30 to be misaligned with the long axis 36 of the upper section 32. In some embodiments, the mechanical joint 222 is configured to transfer torque between the lower and upper sections 30, 32.

Figure 7:
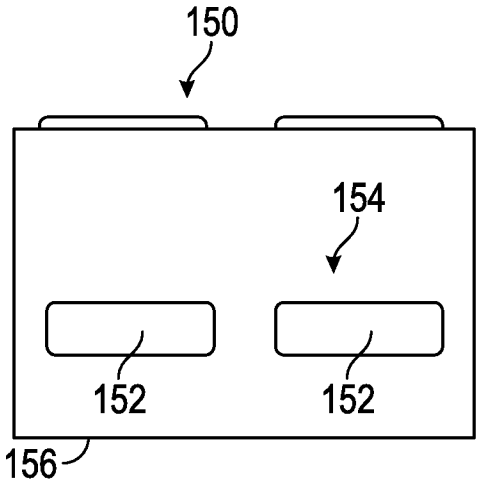
FIG. 7 schematically illustrates a steering assembly with dual pads made in accordance with one embodiment of the present disclosure.

Additionally, in this embodiment, the first steering unit 150 has a row 154 of two axially oriented pads 152. As best seen in FIG. 7, the rows 154 of two or more pads 152 may be circumferentially distributed around a body 156 of the steering unit 150. A multi-pad configuration may also be used for the second steering unit 170 of this embodiment and for the steering units of the other described embodiments. The use of two or more axially arranged pad 152 can increase the power available to turn and steer the drill bit 100 (FIG. 6).

Figure 8:
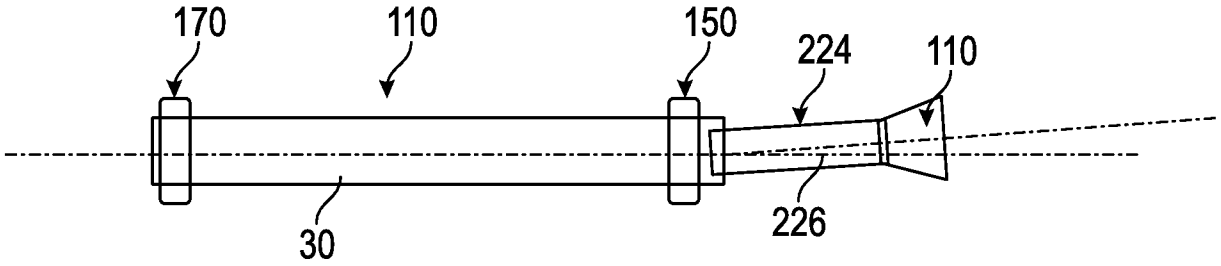
FIG. 8 schematically illustrates a steering assembly used in conjunction with a bent sub made in accordance with one embodiment of the present disclosure.

Referring to FIG. 8, in other embodiments, the steering assembly 110 may be used in conjunction with a complementary steering device such as a bent sub 224. The bent sub 224 may incorporate a fixed deflection that points the drill bit 100 in a desired direction. The first steering unit 150 and the second steering unit 170 may be controlled to enhance or neutralize the fixed deflection. For example, the upward deflection of FIG. 8 can be neutralized by actuating the first steering unit 150 to force the front of the lower BHA section 30 downward and actuating the second steering unit 170 to force the back of the lower BHA section 30 upward. The upward deflection can be amplified by actuating the first steering unit 150 to force the front of the lower BHA section 30 upward and actuating the second steering unit 170 to force the back of the lower BHA section 30 downward.

Referring back to FIG. 5, in other embodiments, two or more steering assemblies may be used to guide the BHA 12 along a borehole 14. For example, the first steering assembly 110 may include steering units 150 and 170 and a second steering assembly 240 may include steering units 242 and 244. The steering assemblies 110, 240 cooperate to bend sections of the BHA 12 as needed to traverse sections of the borehole 14. For example, the steering assembly 110 may steer the drill bit 100 to form a borehole section that has a complex curvature. The second steering assembly 240 can bend a section of the BHA 12 as needed to pass through this complex curvature with reduced interference with the borehole wall 15. More generally, a plurality of steering assemblies may be operated independently to one another. Each steering assembly may cause the associated section of the BHA 12 to bend to accommodate a curvature of the surrounding borehole 14. Thus, one section of the BHA 12 may have a curvature that is different from an adjacent section of the BHA 12.

In yet another embodiment, a steering unit, such as steering unit 150, may be configured to have pads that cannot radially extend to contact a borehole wall. For example, the pads can only extend to a radius of the borehole drilled by the drill bit 100. Such a steering unit can then operate as an active stabilizer. Referring still to FIG. 5, the steering unit 150 may have a restricted radial stroke or extension. When activated to have pad extended but not applying a force to borehole wall, the first steering unit 150 may act as a fulcrum point for the steering force applied by the second steering unit 170.

Figure 9:
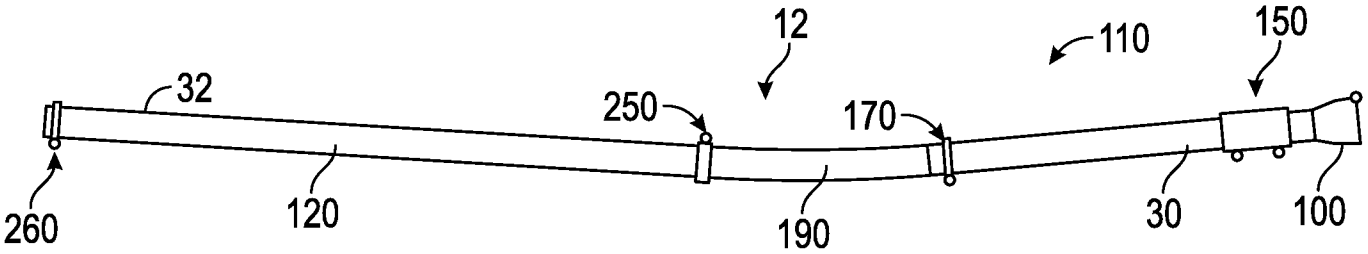
FIG. 9 schematically illustrates a HBA having a plurality of steering assemblies made in accordance with one embodiment of the present disclosure.

Referring now to FIG. 9, there is schematically shown a BHA 12 that includes another embodiment of a steering assembly 110 for steering a drill bit 100. The BHA 12 may include a lower section 30, an upper section 32, and a drilling motor 120. A flex sub 190 connects the upper section 32 to a drilling motor 120. The flex sub 190 may be a flexible joint as previously discussed that is configured to be less rigid than the lower and upper sections 30, 32. In this embodiment, the steering assembly 110 includes a several steering units distributed along the BHA 12.

The lower section 30 includes a first steering unit 150 that is positioned close to the drill bit 100 and the second steering unit 170 is positioned at or near the connection between the flex sub 190 and the lower BHA section 30. The first steering unit 150 has two axially oriented pads 152 as best seen in FIG. 7. The upper BHA section 32 includes a third steering unit 250 that is positioned near the connection between the flex sub 190 and the upper BHA section 32 and a fourth steering unit 260 that is positioned at the opposite end of the upper BHA section 32. The steering units 170, 250, 260 use one force applying pad.

It should be appreciated that in this embodiment, the bending forces for each section of the BHA 12 is varied to accommodate specific operational needs. For instance, the lower section 30 uses a multi-piston steering unit 150 to generate the force necessary to steer the drill bit 100. The steering units 250, 260 for the upper section 32 use single pistons since the generated forces are for orienting the upper section 32 and not primarily for pointing the drill bit 100 in a particular direction.

While the foregoing disclosure is directed to the one mode embodiments of the disclosure, various modifications will be apparent to those skilled in the art. It is intended that all variations within the scope of the appended claims be embraced by the foregoing disclosure.

The invention claimed is:

1. An apparatus for forming a wellbore in a subterranean formation, comprising:

a bottomhole assembly (BHA) having a first BHA section and a second BHA section;

a flex sub connecting the first BHA section to the second BHA section, the flex sub flexing to allow an axial misalignment between the first BHA section and the second BHA section;

a drill bit connected to a first end of the first BHA section;

a drilling motor disposed along the second BHA section, the drilling motor connected to and rotating the drill bit, the flex sub separating the drilling motor from the first BHA section having the drill bit connected to the first end; and a steering assembly positioned along the bottomhole assembly, the steering assembly including:

a first steering unit having at least one pad generating a force in a first direction, and a second steering unit axially spaced apart from the first steering unit, the second steering unit having at least one pad generating a force in a second direction different from the first direction, wherein the first and the second steering units cooperate to axially misalign the first BHA section and the second BHA section at the flex sub.

2. The apparatus of claim 1, wherein the at least one pad of the first steering unit has an angular offset with the at least one pad of the second steering unit, wherein the angular offset is selected to cause the first direction to be opposite to the second direction, and wherein the angularly offset pads of the first and the second steering unit form an offset pad set.

3. The apparatus of claim 2, wherein the first steering unit and the second steering unit are actuated using a pressurized hydraulic fluid, and further comprising a single hydraulic line supplying the pressurized hydraulic fluid to the offset pad set.

4. The apparatus of claim 3, further comprising a hydraulic source disposed in the second BHA section, and wherein the single hydraulic line connects the hydraulic source to the first and the second steering units.

5. The apparatus of claim 1, wherein the first steering unit and the second steering unit are actuated using a pressurized hydraulic fluid, wherein the first and the second steering units each have a plurality of pads, wherein each offset pad set of a plurality of offset pad sets is formed by one pad of the first steering unit and an angularly offset pad of the second steering unit, and further comprising a plurality of hydraulic lines, each of which supplies pressurized hydraulic fluid to a different offset pad set of the plurality of offset pad sets.

6. The apparatus of claim 1, wherein the first steering unit is disposed at the first end and adjacent to the drill bit, wherein the second steering unit is disposed at a second end of the first BHA section.

7. The apparatus of claim 1, wherein the first steering unit and the second steering unit are positioned on opposing sides of the flex sub.

8. The apparatus of claim 1, wherein the flex sub includes one of: (i) a tubular member less rigid than the first BHA section and the second BHA section, and (ii) a mechanical connector.

9. The apparatus of claim 1, wherein the bottomhole assembly has a third and a fourth section, and further comprising:

a second steering assembly positioned along the bottomhole assembly, the second steering assembly including:

a third steering unit having at least one pad generating a force in a third direction, and a fourth steering unit axially spaced apart from the third steering unit, the fourth steering unit having at least one pad generating a force in a fourth direction different from the third direction, wherein the third and the fourth steering units cooperate to axially misalign the third section and the fourth section, and wherein the steering assembly operates independently of the second steering assembly.

10. A method for forming a wellbore in a subterranean formation using a bottomhole assembly (BHA) having a first BHA section, a second BHA section, a drill bit connected to a first end of the first BHA section, and a drilling motor disposed along the second BHA section, the method comprising:

connecting the first BHA section to the second BHA section with a flex sub, the drilling motor connected to and rotating the drill bit, the flex sub separating the drilling motor from the first BHA section having the drill bit connected to the first end, the flex sub flexing to allow an axial misalignment between the first BHA section and the second BHA section;

positioning a steering assembly along the BHA, the steering assembly including a first steering unit and an axially spaced apart second steering unit, each steering unit having at least one pad;

generating a force in a first direction using the first steering unit; and generating a force in a second direction using the second steering unit, the second direction being different from the first direction, the first and the second steering units thereby cooperating to axially misalign the first BHA section and the second BHA section at the flex sub.

11. The method of claim 10, further comprising angularly offsetting the at least one pad of the first steering unit with the at least one pad of the second steering unit, wherein the angular offset is selected to cause the first direction to be opposite to the second direction, and wherein the angularly offset pads of the first and the second steering unit form an offset pad set.

12. The method of claim 11, further comprising:

actuating the first steering unit and the second steering unit using a pressurized hydraulic fluid; and supplying the pressurized hydraulic fluid to the offset pad set using a single hydraulic line.

13. The method of claim 12, further comprising:

disposing a hydraulic source in the second BHA section, wherein the single hydraulic line connects the hydraulic source to the first and the second steering units.

14. The method of claim 10, wherein the first and the second steering units each have a plurality of pads, and wherein a offset pad set is formed by one pad of the first steering unit and an angularly offset pad of the second steering unit, and further comprising:

actuating the first steering unit and the second steering unit using a pressurized hydraulic fluid; and supplying pressurized hydraulic fluid to each offset pad set, wherein a separate hydraulic line supplies the pressurized hydraulic fluid to a different offset pad set.

15. The method of claim 10, wherein the first steering unit is disposed at the first end and adjacent to the drill bit, wherein the second steering unit is disposed at a second end of the first BHA section.

16. The method of claim 10, wherein the first steering unit and the second steering unit are positioned on opposing sides of the flex sub.

17. The method of claim 10, wherein the flex sub includes one of: (i) a tubular member less rigid than the first BHA section and the second BHA section, and (ii) a mechanical connector.

18. The method of claim 10, wherein the bottomhole assembly has a third and a fourth section, and further comprising:

positioning a second steering assembly along the bottomhole assembly, the second steering assembly including a third steering unit and an axially spaced apart fourth steering unit, the third and the fourth steering units each having at least one pad;

generating a force in a third direction using the third steering unit;

generating a force in a fourth direction using the fourth steering unit, the fourth direction being different from the third direction, wherein the third and the fourth steering units cooperate to axially misalign the third BHA section and the fourth BHA section; and operating the steering assembly independently of the second steering assembly.

* * * * *